US005356572A

United States Patent [19]

Takai

[11] Patent Number: 5,356,572

[45] Date of Patent: Oct. 18, 1994

[54] METHOD FOR MANUFACTURING SHEATH-CORE ION EXCHANGE FIBERS

[75] Inventor: Yousuke Takai, Hyogo, Japan

[73] Assignee: Daiwabo Create Co., Ltd., Osaka, Japan

[21] Appl. No.: 99,568

[22] Filed: Jul. 30, 1993

Related U.S. Application Data

[62] Division of Ser. No. 791,240, Nov. 13, 1991, Pat. No. 5,314,922.

[30] Foreign Application Priority Data

Nov. 19, 1990 [JP] Japan ..... 2-313716

[51] Int. Cl.[5] ..... B29C 35/10; D01D 10/00; D01F 8/06; D01F 11/04

[52] U.S. Cl. ..... 264/22; 264/83; 264/171; 264/211.14; 264/232; 264/340

[58] Field of Search ..... 264/22, 83, 171, 211.14, 264/232, 233, 340, 341

[56] References Cited

U.S. PATENT DOCUMENTS 5,171,834 12/1992 Funaki ..... 264/233 X

FOREIGN PATENT DOCUMENTS 62-131004 6/1987 Japan .

OTHER PUBLICATIONS

Abstract of Japan 3-249,265 (Published Nov. 7, 1991).

English translation of Japan 62-131,004 (Published Jun. 13, 1987).

*Primary Examiner*—Leo B. Tentoni

*Attorney, Agent, or Firm*—Fish & Richardson

[57] ABSTRACT

Ion exchange fibers including a polymer component having a main chain of a syndiotactic poly(1,2-butadiene) structure and containing ion exchange functional groups introduced at least part of side chain ethylene groups. These fibers may be suitably formed into a non-woven fabrics, and thus an ion exchange cloth can be obtained, which has excellent ion exchange capacity, flexiblity excellent processing capacity, high mechanical strength and elongation. The ion exchange fibers have excellent ion exchange capacity with respect to fluid such as water or gas and thus can be used as cartridge filters and fiber-filled filters.

2 Claims, 5 Drawing Sheets 100
80
60
40
20
0
TRANSMITTANCE(%)
4000
3000
2000
1600
1200
800
650
WAVENUMBER (CM-1)
1
2
3
4
5
6

METHOD FOR MANUFACTURING SHEATH-CORE ION EXCHANGE FIBERS

This application is a division of U.S. application Ser. No. 07/791,240, filed Nov. 13, 1991, now U.S. Pat. No. 5,314,922.

FIELD OF THE PRESENT INVENTION

This invention relates to novel and improved ion exchange fibers and a method for manufacturing the same.

BACKGROUND OF THE INVENTION

Ion exchange polymers are useful in many industrial fields such as electrical engineering, electronics, semiconductors, precision engineering, food industries, medicine, nuclear power and water treatment.

Conventional ion exchange resins include styrene-divinyl benzene copolymer, acrylic acid- or methacrylic acid-divinyl benzene copolymer.

As conventional ion exchange fibers, conjugate fibers, in which a polymer of aromatic monovinyl compounds constitutes a sheath component, are used as base fibers, as disclosed in Japanese Published Patent Application (Kokai) No. 186/1974, Japanese Published Patent Application (Kokai) No. 94,233/1975, Japanese Published Patent Application (Kokai) No. 12,985/1977 and Japanese Published Patent Application (Kokai) No. 120,986/1977. Other conventional techniques involving melt spun fibers of styrene-divinyl benzene copolymer are disclosed in Japanese Published Patent Application (Kokai) No. 81,169/1973.

Dry spun fibers of baked polyvinyl alcohol are disclosed in Japanese Published Patent Application (Kokai) No. 71,815/1980 and Japanese Published Patent Application (Kokai) No. 184,113/1987, and acrylonitrile fibers are disclosed in Japanese Published Patent Application (Kokai) No. 50,032/1980.

In the prior art, however, with a thermoplastic polymer for manufacturing fibers the melt fluidity is reduced very much in proportion to the increasing cross-linking of the thermoplastic polymer. In this case, therefore, it is impossible to use the usual extruder, but it is necessary to use a very high pressure specific extruder for manufacturing such fibers.

Further, baked polyvinyl alcohol fibers or the like are hard and fragile, and it is difficult to subject them to the usual processing of fibers such as carding, webbing, spinning to spun yarns, fabrication, knitting and producing non-woven fabrics, etc.

SUMMARY OF THE INVENTION

To solve the above problems inherent in the prior art, it is an object of the present invention to provide an ion exchange polymer which is soft and readily capable of fiber-production processing.

It is an another object of the present invention to provide ion exchange fibers using such a polymer.

It is a further object of the present invention to provide ion exchange fibers which have excellent ion exchange capacity, excellent flexibility, sufficient processablity, adequate mechanical strength and adequate elongation.

It is a further object of the present invention to provide single component fibers or conjugate fibers having excellent ion exchange capacity.

It is a further object of the present invention to provide ion exchange fibers which are easily processible into non-woven fabrics.

It is yet another object of the present invention to provide manufacturing methods for ion exchange fibers by melt spinning.

It is yet another object of the present invention to provide maunfacturing methods for the melt spinning of ion exchange conjugated fibers.

In order to accomplish the above objects, this invention provides ion exchange fibers at least partially containing a polymer component having a main chain of a syndiotactic poly(1,2-butadiene) structure and having ion exchange functional groups introduced into at least part of the side chain ethylene groups.

It is preferable in this invention that the above mentioned polymer has a unit represented by the following formula:

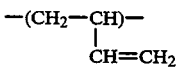

[A]

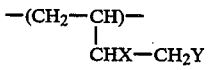

[B]

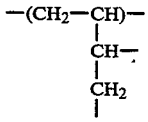

[C]

wherein X and Y are the same or different and denote a member selected from the group consisting of sulfonic acid groups or an alkali metal salt groups thereof, carboxyl groups or alkali metal salt groups thereof, phosphine groups or alkali metal salt groups thereof, amino groups, alkylamino groups, alkoxyamino groups, halogenated alkylamino groups and polyamine groups or derivative groups from the afore-said groups.

It is preferable in this invention that the fibers are sheath-core type conjugated fibers wherein a polymer component of the sheath part comprises a polymer having a main chain of a syndiotactic poly(1,2-butadiene) structure and having ion exchange functional groups introduced into at least part of the side chain ethylene groups and wherein a polymer component of the core part comprises polypropylene polymers.

It is preferable in this invention that the ion exchange fibers are core-sheath type ion exchange fibers formed into non-woven fabrics through a thermal fusion bonding integration treatment.

In its process aspects, the present invention relates to a method for manufacturing ion exchange fibers comprising the steps of forming fibers by melt spinning syndiotactic poly(1,2-butadiene) having a melting point (Tm °C.) of $75 \leqq Tm < 150$, preferably carrying out a cross-linking treatment on said fibers with ultraviolet rays or radioactive rays, and subsequently carrying out a chemical treatment or physicochemical treatment on said fibers to introduce ion exchange functional groups thereinto.

It is preferable in this invention that in the method for manufacturing ion exchange fibers according to above mentioned method, the melt spinning produces melt spinning core-sheath type conjugate fibers comprising the syndiotactic poly(1,2-butadiene) as a sheath part and a polypropylene polymer as a core part.

DETAILED DESCRIPTION OF THE INVENTION

Figure 1:
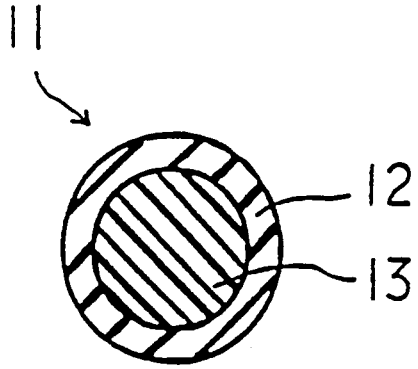
FIG. 1 is a sectional view showing ion exchange conjugate fibers of one of the embodiments of the invention.

The ion exchange fibers of the invention comprise an ion exchange polymer, which has a main chain of a syndiotactic poly(1,2-butadiene) structure, and in which ion exchange functional groups are introduced into at least part of the side chain ethylene groups.

The polymer having this structure preferably has at least the units represented by the following formulas [A], [B] and [C]:

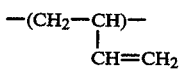

[A]

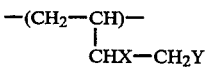

[B]

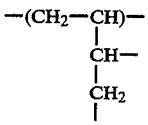

[C]

wherein X and Y are the same or different and denotes a member selected from the group consisting of sulfonic acid groups or alkali metal salt groups thereof, carboxyl groups or alkali metal salt groups thereof, phosphine groups or alkali metal salt groups thereof, amino groups, alkylamino groups, alkoxyamino groups, halogenated alkylamino groups and polyamine groups and groups derived from the afore-mentioned groups.

As the alkylamino group, an alkylamino group having 1 to 10 carbon atoms is usually used. As the alkoxyamino group, an alkoxyamino group having 1 to 10 carbon atoms is usually used.

As the halogenated alkylamino group, a halogenated alkylamino group having 1 to 10 carbon atoms is usually used. As the polyamine group, a group having 20 or fewer carbon atoms is usually used. In these halogenated alkylamino groups, chloride or bromide are usually used as the halogen component. In the foregoing alkali metal salt groups, sodium or potassium salts are preferable.

It is easy to change the sulfonic acid group, carboxyl group or phosphine group into the alkali metal salt group thereof by treatment with aqueous solution of alkali hydroxide such as sodium hydroxide and potassium hydroxide etc.

The ion exchange polymer noted above according to the invention is soft and has sufficient mechanical strength, and the fibers comprising the ion exchange polymer can be processed as usual fibers for woven and knitted fabrics and non-woven fabrics. Thus, their ion exchange polymer can find very extensive applications. In addition, its ion exchange performance may be made practically sufficient. Of course, it may be used not only for fibers but also for films, sheets, moldings and particles. This is so because ion exchange functional groups can be introduced in a treatment subsequent to the melt molding (including melt spinning) of syndiotactic poly(1,2-butadiene).

Further, with the preferred structure according to the invention that the polymer has at least the units represented by the formulas [A],[B] and [C] noted above, it is possible to make the ion exchange capability sufficient and provide a soft polymer.

The unit of formula [A] mainly provides for the flexibility of the polymer, and it is preferably contained in amounts of 5 to 99 mol %, more preferably 15 to 90 mol % of entire polymer.

The unit of formula [B] has ion exchange capability (X and Y are the same or different and representing an ion exchange functional group as mentioned above), and it is peferably contained in amount of 1 to 85 mol %, more preferably 5 to 70 mol % of the entire polymer.

The unit of formula [C] serves as a cross-linking part. This unit may be absent in gas ion exchange application, but in liquid ion exchange application it is preferably present for preventing the dissolving of the main chain skelton of the polymer. For this reason, this unit is suitably contained by 0 to 10 mol % of the entire polymer, especially 2 to 9 mol % in liquid ion exchange application.

In addition to the units of the formulas [A] to [C], other copolymer units or additives may be contained in ranges permitting the attainment of the function and effects of the invention. For example, as a unit of polymer may be contained a side chain carboxyl group represented by the following formula [D]

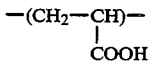

[D]

The fibers according to the invention may be provided as usual single component fibers or conjugate fibers. In the case of the single component fibers, the cost of manufacturing can be reduced.

The ion exchange single component fibers according to the invention may be produced by usual melt spinning of the polymer having a repeating unit represented by the formula [A], preferably syndiotactic poly(1,2-butadiene) having a melting point (Tm °C.) of $75 \leqq Tm < 150$, then if necessary and preferably subjected to a cross-linking treatment with ultraviolet rays or radioactive rays and then subjected to a chemical or physico-chemical treatment for introduction of ion exchange functional groups. Thus, the fibers are applicable to any application as usual fibers, such as for woven or knitted fabrics and for non-woven fabrics. In the case of conjugate fibers, for instance core-sheath conjugate fibers, high mechanical strength fibers may be obtained by using a high mechanical strength polymer such as polypropylene or copolymers thereof for the core of the fibers. Moreover, when the ion exchange polymer according to the invention is used for the sheath component, the ion exchange capability is maintained owing to ion exchange functional groups present in a portion in contact with liquid or gas.

As methods for manufacturing these sheath-core type conjugated fibers of the present invention, the same methods disclosed before are available, except the use of usual bi-component fiber spinning machine.

Namely, sheath-core conjugated fibers are produced by melt spinning a polymer having a repeating unit represented by the formula [A], preferably syndiotactic poly(1,2-butadiene) having a melting point (Tm °C.) of $75 \leqq Tm < 150$, as a sheath component, and polypropyrene polymers as core component by using bicomponent spinning machine, then if necessary and preferably subjected to a cross-linking treatment with ultraviolet rays or radioactive rays and then subjected to a chemical or physicochemical treatment for introduction of ion exchange functional groups.

In ion exchange sheath-core type conjugated fibers according to the present invention, the conjugate ratio of the sheath part to the core part is preferaby in the range of 30/70 to 30/70 in the cross sectional area ratio of the sheath part to the core part.

The ion exchange fibers according to the invention has characteristics like those of usual synthetic fibers such as mechanical strength, elongation, flexibility and processing properties. For example, when cut fibers are prepared, they may be smoothly passed through a card to obtain spun yarns, or they may be formed into a web which is to be processed to obtain non-woven fabrics.

Further, the ion exchange non-woven fabric according to the invention, which uses the ion exchange fibers noted above for at least part of it and is obtained by thermal fusion bonding integration, can be suitably used for, for instance, cartridge filters and fiber-filled filters.

The ion exchange non-woven fabrics according to the invention may be composed of the ion exchange fibers according to the invention or a mixture of the ion exchanging fibers and usual fibers such as polypropylene fibers, polyester fibers, polyamide fibers or cellulose fibers etc.

EXAMPLES

Specific examples of the invention will be given hereinunder. It is to be construed that the examples are by no means limitative. In the following description of the examples, syndiotactic poly(1,2-butadiene) is abbreviated as 1,2-SBD.

I found that conjugate fibers composed of 1,2-SBD as a sheath (referred to as sheath component) and polypropylene as a core (referred to as core component) could be readily obtained by melt spinning and is readily capable of being thermally stretched, that staples of these fibers could be used to manufacture thermally bonded non-woven fabrics by producing a card web of the staples and causing thermal bonding with 1,2-SBD of the sheath component at the temperature of fusion of 1,2-SBD, and that 1,2-SBD could be readily cross-linked to produce larger molecules by irradiating it with ultraviolet rays or radioactive rays such as gamma rays. I also found that the fibers and non-woven fabrics could have ion exchange functional groups introduced into them with a sulfonation reaction etc. to unsaturated groups such as side chain ethylene groups with thermal concentrated sulfuric acid without damage and were also chemically stable in other ion exchange group introduction reactions because the main chain of the molecule was constituted by carbon-to-carbon bonds.

As 1,2-SBD which is possible to be cross-linked and introduced ion exchange group, 1,2-SBD having a melting point (Tm °C.) of $75 \leqq Tm < 150$ is preferable. 1,2-SBD having the above mentioned melting point can be easily melt spun, and especially it is possible to carry out stable melt spinning in manufacturing sheath-core type conjugated fibers comprising 1,2-SBD as the sheath component and polyolefin as the core component. And also easy thermal bonding is possible in producing thermally bonded non-woven fabrics. The 1,2-SBD more preferably has a melting point of 75° to 120° C., a crystallization degree of 15 to 50%, 90% or above of 1,2 bonding, and a melt index (MI as measured at 190° C. and with a load of 2,169 g in accordance with JIS K 7210) of 20 to 150 g per 10 minutes. The thermally meltable resin used as the core component is preferably polyolefin having a melting point of 180° C. or below; PP (polypropylene polymers) is used conveniently. PP is a homopolymer, a binary copolymer or a ternary copolymer of propylene and preferably has a melting point of 170° C. or below and MI of 20 to 150 g per 10 minutes as defined above. As the PP/1,2-SBD conjugate fibers are preferred combinations of 1,2-SBD having a melting point of 80° to 110° C. and a MI of 40 to 120 g per 10 minutes and PP having a melting point of 150° to 165° C. and a MI of 30 to 70 g per 10 minutes.

In the production of these fibers in the examples, preferably a melt spinning temperature (T °C.) of $165 < T < 200$, more preferably $T \leqq 180$, is used. If the melt spinning temperature is over 200° C., gelation of 1,2-SBD is liable to occur. The fiber structure is preferably sheath-core type conjugate fibers with 1,2-SBD as the sheath and PP as the core.

Where 1,2-SBD is used as a thermal bonding component to obtain a thermally bonded non-woven fabric, it is suitable to incorporate at least 30 wt. % of PP/1,2-SBD conjugate fibers based on the total weight of fibers which make up the non-woven fabric. This provides sufficient thermal bonding properties. Particularly the use of 100% conjugate fibers is preferable. The thermal bonding temperature (T °C.) at this process is preferably in a range of $Tm(SBD)+10 \leqq T \leqq Tm(pp)-10$ where Tm(SBD) °C. and Tm(pp) °C. are respectively the melting points of 1,2-SBD and PP.

Fibers with the surface thereof constituted by 1,2-SBD obtained in the above way or non-woven fabrics thermally bonded with these fibers may be irradiated with ultraviolet rays or gamma rays to cause a cross-linking reaction of 1,2-SBD. The resultant fibers and non-woven fabrics have properly increased rigidity but not so far as improper rigidity of the conventional ion exchange fibers, increased melting and softening points as represented by the thermally severing temperature ($\theta$ °C.) which will be described later and reduced tensile breaking strength and tensile elongation. The cross-linking is conveniently carried out by irradiating the fibers or non-woven fabric with ultraviolet rays emitted from a 800-W high pressure mercury lamp held at a distance of 20 to 30 cm for 5 to 20 minutes.

Into the fibers or non-woven fabric after cross-linking in the above way, ion exchange functional groups such as sulfonic acid groups etc. are introduced by a chemical treatment or physicochemical treatment such as dipping the fibers or non-woven fabrics in a diluted fuming sulfuric acid cooled to 10° C. or below, or in a 80 to 90% concentrated sulfuric acid heated to 80° C. or above. By washing the resultant fibers with water and dipping them in an 1 N sodium hydroxide solution, the sulfonic acid groups are converted to sodium salt groups thereof, thus providing an excellent ion exchange property. Fibers not having been cross-linked are partially dissolved, and therefore cross-linking treatments are preferable. Of course, the ion exchange group introduction is not limited to the above reactions, and it is possible to introduce any ion exchange functional group such as amino group, amide group, carboxyl group, phosphinic acid group, alkylamino group, alkoxyamino group, halogenated alkylamino group and polyamine group etc.

The 1,2-SBD used in the examples has unsaturated ethylene group $-CH=CH_2$ in the side chain. These double bonds readily provide intermolecular cross-linking into larger molecules with irradiation of ultraviolet rays etc. The ethylene groups which have not undergone the cross-linking reaction are highly chemically active and permit ready introduction of ion exchange groups such as sulfonic acid groups. When the introduced ion exchange groups are used for salt removal or like purpose, the ion exchange groups change into the form of salt type but the ion exchange fibers retain their insolubility in water since the fibers have enlarged giant molecular weight by the cross-linking.

The 1,2-SBD used in the examples has a melting point (Tm °C.) of $75 \leqq T < 150$, preferably $75 \leqq T < 120$, and can be used to readily manufacture a thermally bonded non-woven fabric using a usual hot air penetration type thermal bonding machine. By using sheath-core type conjugate fibers containing the 1,2-SBD, a non-woven fabric, the fiber surface of which is occupied by the 1,2-SBD, can be obtained. This is convenient in that it is possible to obtain a non-woven fabric comprising the fibers having ion exchange capacity in at least the surface thereof by introduction of ion exchange groups.

In the examples, preferable fibers with the surface thereof constituted by low-melting 1,2-SBD with the side chain thereof having high density of unsaturated ethylene groups readily capable of a cross-linking reaction, are irradiated with ultraviolet rays or radioactive rays to cause cross-linking of 1,2-SBD into enlarged giant molecules. The fibers are thus rendered insoluble to water even with introduction of a large quantity of hydrophilic groups, and then they are subjected to a chemical or physicochemical treatment to introduce a great quantity of hydrophilic functional groups having ion exchange capacity into a part of the ethylene groups of the fibers. Examples of the physicochemical treatment are generating radicals by photochemical treatment, low temperature plasma treatment, corona discharge treatment and so forth under the presence of such agents as ammonia, amines etc. and reacting these radicals with the unsaturated ethylene groups. Ammonia gas is directly introduced to the unsaturated etylene group by addition reaction under the irradiation of a low pressure mercury lamp as the typical physicochemical treatment. The fineness of the ion exchange fibers are not restricted, but fibers having deniers of from 0.5 to 100 are usually used. In production of non-woven fabrics, fibers having deniers of 0.5 to 10 are preferable, and deniers of 1 to 4 are more preferable.

The examples will now be described in detail.

EXAMPLES 1 TO 4

(Examples of cross-linked single component fibers)

Polymer of 1,2-SBD ("JSR-RB T-871" manufactured by Japan Synthetic Rubber Co., Ltd.) having a melting point of 90° C. and an MI of 145 g per 10 minutes was used for melt spinning using a spinneret with a spin hole number of 700, with a discharge rate of 240 g/min. and at a spinning temperature of 180° C. The obtained fibers were stretched to 3.6 times in hot water at 60° C., then given mechanical crimp in a cooled stuffer box, then dried in a net conveyor type hot air penetration drier at 50° C. and cut to 51 mm to obtain staple fibers.

(a) Cross-linking with ultraviolet ray irradiation:

The fibers were irradiated, while supplying air, with ultraviolet rays from a high pressure mercury lamp ("Unicure UV-800" by Ushio Electric Co., Ltd.) with a wavelength of 100 mm and a power of 800 W and with the lamp held at a distance of 200 mm.

(b) Cross-linking with gamma ray irradiation:

A fiber sample was put into a stainless steel container, and the container was sunk in a pool of water and irradiated with gamma rays from a $Co^{60}$ gamma ray source via water at a rate of 4.36 MR/h (Mega tads/hour).

The fibers after the cross-linking were treated in concentrated sulfuric acid having a concentration of 92.5% for 5 hours at a temperature of 92° C. to obtain sulfonated fibers. The weight increase was measured.

Then, thus introduced salfonic acid groups were turned into sodium salt groups thereof in a 1 N aqueous solution of NaOH, then the weight increase was measured, and the percentage of water-insoluble sulfonic acid groups was calculated.

The measuring of the melting or softening point of fibers is shown in terms of the fiber breaking temperature ($\theta$ °C.). This temperature of $\theta$ °C. is measured in accordance with a thermal shrinkage temperature measurement method of JIS L-10157-16-2 by increasing the ambient temperature around fibers at a rate of 1° C./min. under an applied load of 1 mg/d. It is a temperature, at which the fibers are broken as a result of softening, and is closely related to the melting point.

The sulfonation percentage (mol %) is represented as that of the ethylene group and calculated by using the following equation.

$$\text{Solfonation percentage (mol \%)} = \{\text{weight increasing (\%)}/97\}/\{100/56\}$$

The insolubility percentage is calculated as the percentage of water-insoluble sulfonic acid groups by the following equation.

$$\text{Insolubility (\%)} = \{\text{weight increasing (\%)}/22\}/\{\text{sulfonation percentage (mol \%)}\}$$

The data of the ion exchange fibers obtained under the above conditions are disclosed in Table 1.

Comparative Examples 1 and 2

High density polyethylene (HDPE) having a melting point of 130° C. and a MI of 145 g per 10 minutes and polypropylene(PP) were used individually for spinning under the same conditions as in Example 1, and the obtained fibers were stretched to four times in hot water at 80° C. to obtain comparative staple fibers. It is apparent from these comparative examples that ion exchange groups were not introduced, in despite of the treatment with the concentrated sulfulic acid.

The data of the non-ion exchange fibbers obtained under the above conditions are also disclosed in Table 1.

EXAMPLES 5 TO 11

(Examples of cross-linked conjugate fibers)

Sheath-core type conjugate fibers composed of a polymer of 1,2-SBD ("JSR-RB T-871" manufactured by Japan Synthetic Rubber Co.,Ltd.) having a melting point of 90° C. and a MI of 145 g per 10 minutes as sheath component and of polypropylene (PP) having a melting point of 160° C. and a MI of 145 g per 10 minutes as core component, were obtained by melt spinning using bi-component fiber spinning machine and a spinneret having a spin hole number of 700 and setting the discharge rate to 240 g/min., the spinning temperature to 180° C. and conjugate ratio of the sheath part to the core part given as conjugate fiber sectional area ratio to 1:1, and they were stretched to 3.6 times in hot water at 60° C., then given mechanical crimp using a cooled stuffer box, then dried in a net conveyer type hot air penetration drier at 50° C. and then cut to 51 mm to obtain staple fibers. Ion exchange groups were introduced by the same method as Example 1.

The data of the ion exchange fibers obtained under the above conditions are disclosed in Table 2.

The total ion exchange capacity in case where the ion exchange groups of the ion exchange fibers in Example 5 were of —$SO_3Na$ type, was about 2 mg equivalence per g.

EXAMPLE 12

The fibers before introduction of ion exchange groups disclosed in Example 5 were treated using 3% fuming sulfuric acid at 5° C. for 3 minutes. A sulfonation percentage of 57% was obtained.

EXAMPLES 13 TO 19

(Examples of non-woven fabrics)

The PP/1,2-SBD core-sheath type conjugate fibers in Example 5 and single component polypropylene fibers in Comparative example 2 were used to form webs by passing them through a roller card. The webs were then heat treated for one minute in a hot air penetration type thermal processor at 110° C. to melt 1,2-SBD as the sheath component and thus fibers of the webs were heat bonded one another. The obtained non-woven fabrics have a thickness of 2 mm and a weight of 40 g/m$^2$. These non-woven fabrics were subjected to cross-linking by ultraviolet ray irradiation and subsequent sulfonation in the manner described before in connection with Example 5.

The mechanical strength of the non-woven fabrics was measured by carrying out a tensile test of a non-woven fabric sample having a width of 50 mm and a test length of 100 mm and was measured at a tensile speed of 300 mm/min. It is represented as a breaking length calculated using the following equation. As for the direction of the non-woven fabric, the direction of the web discharging from the card is the longitudinal direction, and the width direction of the web is the transversal direction.

$$\text{Breaking length (km)} = \text{tensile breaking strength (g)}/\{50 \times \text{weight (g/m}^2)\}$$

The data of the non-woven fabric obtained under the above conditions are disclosed in Table 3.

EXAMPLES 20 TO 26

(Examples of non-cross-linked)

Sole 1,2-SBD ("JSD-RB T-871" manufactured by Japan Synthetic Rubber Co., Ltd.) having a melting point of 90° C. and a MI of 145 g per 10 minutes was used for melt spinning using a spinneret having a spin hole number of 700 and by setting a discharge rate of 240 g per min. and a spinning temperature of 180° C. In addition, core-sheath type conjugate fibers composed of the above resin as sheath component and polypropylene having a melting point of 160° C. and a MI of 145 g per 10 min. as core component were obtained by melt spinning under the same conditions and also setting the fiber sectional area ratio to 1:1 in the conjugate ratio. These fibers were then stretched to 3.6 times in hot water at 60° C., then given mechanical crimp in a cooled stuffer box, then dried in a net conveyer type hot air penetration drier at 50° C., and then cut to 51 mm to obtain staple fibers.

These fibers were then treated in 50% concentrated sulfuric acid at 92° C. for 5 hours to obtain sulfonated fibers, and the weight increase thereof was measured. Then, thus introduced sulfonic acid groups were turned into sodium salt groups thereof in a 1N an aqueous solution of NaOH, and the weight increase was measured to calculate the percentage of water-insoluble sulfonic acid groups.

The data of the fibers obtained under the above conditions are disclosed in Table 4.

COMPARATIVE EXAMPLES 3 AND 4

(non cross-linked fibers)

High density polyethylene (HDPE) having a melting point of 130° C. and a MI of 145 g per 10 min. and polypropylene(PP) were used individually for spinning under the same conditions as in Example 20. The fibers obtained were stretched to 4 times in hot water at 80° C. to obtain comparative staple fibers.

The data of the ion exchange fibers obtained under the above conditions are disclosed in Table 5.

EXAMPLES 27 TO 33

(Examples of non-cross-linked non-woven fabrics)

The PP/1,2-SBD core-sheath type conjugate fibers of Example 24 and sole polypropylene fibers of Comparative example 4 were used and passed through a roller card to obtain webs. These webs were then heat treated for one minute in a hot air penetration type thermal processor at 110° C. to obtain a non-woven fabrics having a thickness of 2 mm and a weight of 40 g/m$^2$. These non-woven fabrics were sulfonated in the manner as described before in connection with Example 24. The data of the results are disclosed in Table 6.

TABLE 1

| | Example No. | | | | Comparative Example No. | |
|---|---|---|---|---|---|---|
| | 1 | 2 | 3 | 4 | 1 | 2 |
| Kind of fibers | Single | Single | Single | Single | Single | Single |
| Combination of component (core/sheath) | 1,2 SBD | 1,2 SBD | 1,2 SBD | 1,2 SBD | HDPE | PP |
| Untreated Original fiber | | | | | | |
| ①Fineness (deniers) | 19 | 10 | 4 | 19 | 2 | 2 |
| ②Tensile strength (g/d) | 0.9 | 0.9 | 0.9 | 0.9 | 4.0 | 5.7 |
| ③Breaking elongation (%) | 130 | 130 | 120 | 130 | 80 | 35 |
| ④Breaking temperature (°C.) | 106 | 105 | 102 | 106 | 132 | 161 |
| Cross-linking | | | | | | |
| ①Method of cross-linking | UV | UV | UV | γ ray | UV | UV |
| ②Irradiation time (min.) | 60 | 60 | 60 | — | 60 | 60 |
| ③Irradiation dosage (M rad) | — | — | — | 10 | — | — |
| Results of crosslinking | | | | | | |
| ①Tensile strength (g/d) | 0.9 | 0.9 | 0.9 | 0.8 | 4.0 | 5.7 |
| ②Breaking elongation (%) | 95 | 90 | 85 | 40 | 80 | 35 |
| ③Breaking temperature (°C.) | 108 | 108 | 108 | 145 | 132 | 161 |
| Sulfonation percentage (mol %) | 3 | 5 | 10 | 3 | 0 | 0 |
| Insolubility percentage (%) | 96 | 100 | 100 | 98 | — | — |

TABLE 2

| | Example No. | | | | | | |
|---|---|---|---|---|---|---|---|
| | 5 | 6 | 7 | 8 | 9 | 10 | 11 |
| Kind of fibers | Conjugate | Conjugate | Conjugate | Conjugate | Conjugate | Conjugate | Conjugate |
| Combination of component (core/sheath) | PP/ 1,2 SBD | PP/ 1,2 SBD | PP/ 1,2 SBD | PP/ 1,2 SBD | PP/ 1,2 SBD | PP/ 1,2 SBD | PP/ 1,2 SBD |
| Untreated Original fiber | | | | | | | |
| ①Fineness (deniers) | 2 | 2 | 2 | 2 | 3 | 3 | 4 |
| ②Tensile strength (g/d) | 1.9 | 1.9 | 1.9 | 1.9 | 1.9 | 1.9 | 1.9 |
| ③Breaking elongation (%) | 80 | 80 | 80 | 80 | 90 | 90 | 90 |
| ④Breaking temperature (°C.) | 165 | 165 | 165 | 165 | 165 | 165 | 165 |
| Cross-linking | | | | | | | |
| ①Method of cross-linking | UV | UV | UV | γ ray | UV | γ ray | UV |
| ②Irradiation time (min.) | 15 | 60 | 180 | — | 60 | — | 60 |
| ③Irradiation dosage (M rad) | — | — | — | 10 | — | 50 | — |
| Results of crosslinking | | | | | | | |
| ①Tensile strength (g/d) | 1.9 | 1.9 | 1.9 | 1.5 | 1.9 | 1.5 | 1.9 |
| ②Breaking elongation (%) | 80 | 80 | 60 | 70 | 90 | 60 | 90 |
| ③Breaking temperature (°C.) | 165 | 160 | 155 | 150 | 160 | 200 | 160 |
| Sulfonation percentage (mol %) | 25 | 19 | 16 | 20 | 13 | 14 | 10 |
| Insolubility percentage (%) | 100 | 101 | 101 | 101 | 101 | 101 | 100 |

TABLE 3

| | Example No. | | | | | | |
|---|---|---|---|---|---|---|---|
| Non-woven fabric | 13 | 14 | 15 | 16 | 17 | 18 | 19 |
| Mixed ratio of fibers | | | | | | | |
| *Fibers (%) of Example 5 | 100 | 100 | 100 | 100 | 100 | 70 | 30 |
| *Fibers (%) of Comparative example 2 | 0 | 0 | 0 | 0 | 0 | 30 | 70 |
| Before Irradiation | | | | | | | |
| ①Longitudinal direction | | | | | | | |
| *Mechanical strength (km) | 3.9 | 3.9 | 3.9 | 3.9 | 3.9 | 3.5 | 1.5 |
| *Elongation (%) | 59 | 59 | 59 | 59 | 59 | 62 | 82 |
| ②Transvers direction | | | | | | | |
| *Mechanical strength (km) | 1.0 | 1.0 | 1.0 | 1.0 | 1.0 | 0.9 | 0.5 |
| *Elongation (%) | 65 | 65 | 65 | 65 | 65 | 70 | 90 |
| After Irradiation | | | | | | | |
| ①Longitudinal direction | | | | | | | |
| *Mechanical strength (km) | 3.8 | 3.8 | 3.8 | 3.8 | 3.8 | 3.4 | 1.5 |
| *Elongation (%) | 56 | 56 | 56 | 56 | 56 | 59 | 80 |
| ②Transvers direction | | | | | | | |
| *Mechanical strength (km) | 1.0 | 1.0 | 1.0 | 1.0 | 1.0 | 0.9 | 0.5 |
| *Elongation (%) | 62 | 62 | 62 | 62 | 62 | 65 | 85 |
| Sulfonation temperatur (°C.) | 92 | 90 | 80 | 70 | 60 | 92 | 92 |
| Sulfonation time (hr.) | 5 | 1 | 1 | 1 | 1 | 5 | 5 |
| Sulfonation percentage (mol %) | 25 | 23 | 18 | 14 | 11 | 17 | 8 |
| Insolubility percentae (%) | 100 | 100 | 100 | 100 | 100 | 100 | 100 |

TABLE 4

| | Example No. | | | | | | |
|---|---|---|---|---|---|---|---|
| | 20 | 21 | 22 | 23 | 24 | 25 | 26 |
| Kind of fibers | Single | Single | Single | Single | Conjugate | Conjugate | Conjugate |
| Combination of fiber (core/sheath) | 1,2 SBD | 1,2 SBD | 1,2 SBD | 1,2 SBD | PP/ 1,2 SBD | PP/ 1,2 SBD | PP/ 1,2 SBD |
| Properties of untreated original fiber | | | | | | | |
| ①Fineness (deniers) | 19 | 10 | 4 | 19 | 2 | 3 | 4 |
| ②Tensile strength (g/d) | 0.9 | 0.9 | 0.9 | 0.9 | 1.9 | 1.9 | 1.9 |
| ③Breaking elongation (%) | 130 | 130 | 120 | 130 | 80 | 90 | 90 |
| ④Breaking temperature (°C.) | 106 | 105 | 102 | 106 | 165 | 165 | 165 |
| Sulfonation percentage (mol %) | 3 | 5 | 11 | 3 | 28 | 14 | 12 |
| Insolubility percentage (%) | 86 | 97 | 96 | 85 | 82 | 85 | 79 |

TABLE 5

| | Comparative Example No. | |
|---|---|---|
| | 3 | 4 |
| Kind of fibers | Single | Single |
| Component | HDPE | PP |
| Properties of fiber | | |
| ①Fineness (deniers) | 2 | 2 |
| ②Tensile strength (g/d) | 4.0 | 5.7 |
| ③Breaking elongation (%) | 80 | 35 |
| ④Breaking temperature (°C.) | 132 | 161 |
| Sulfonation percentage (mol %) | 0 | 0 |
| Insolubility percentage (%) | — | — |

TABLE 6

| | Example No. | | | | | | |
|---|---|---|---|---|---|---|---|
| Non-woven fabric | 27 | 28 | 29 | 30 | 31 | 32 | 33 |
| Mixed ratio of fibers | | | | | | | |
| *Fibers (%) of Example 24 | 100 | 100 | 100 | 100 | 100 | 70 | 30 |
| *Fibers (%) of Comparative example 4 | | | | | | | |
| Before Irradiation | | | | | | | |
| ①Longitudinal direction | | | | | | | |
| *Mechanical strength (km) | 3.9 | 3.9 | 3.9 | 3.9 | 3.9 | 3.5 | 1.5 |
| *Elongation (%) | 59 | 59 | 59 | 59 | 59 | 62 | 82 |
| ②Transvers direction | | | | | | | |
| *Mechanical strength (km) | 1.0 | 1.0 | 1.0 | 1.0 | 1.0 | 0.9 | 0.5 |
| *Elongation (%) | 65 | 65 | 65 | 65 | 65 | 70 | 90 |
| Sulfonation temperatur (°C.) | 92 | 90 | 80 | 70 | 60 | 92 | 92 |
| Sulfonation time (hr.) | 5 | 1 | 1 | 1 | 1 | 5 | 5 |
| Sulfonation percentage (mol %) | 28 | 25 | 20 | 15 | 11 | 21 | 12 |
| Insolubility percentage (%) | 82 | 84 | 80 | 81 | 85 | 80 | 75 |

Now, an embodiment of the invention will be described with reference to the drawings.

FIG. 1 is a sectional view showing ion exchange conjugate fibers of one of embodiment of the invention. Referring to FIG. 1, a conjugate fiber 11 comprises an ion exchange polymer layer 12 (or seath component layer), and a polypropyrene layer 13 (or a core component layer).

In the conjugate fibers 11 having this structure, as the ion exchange polymer layer (i.e., seath component layer) 12 is used a polymer component having ion exchange groups as mentioned above. In this structure, the ion exchange polymer is present on its surface that will be in contact with liquid or gas, thus permitting efficient ion exchange.

FIGS. 2 to 5 show charts of infrared ray (IR) absorption spectrum analyses of the film of the ion exchange polymer according to the invention and the film of the polymer material before the introduction of the ion exchange functional groups.

Figure 2:
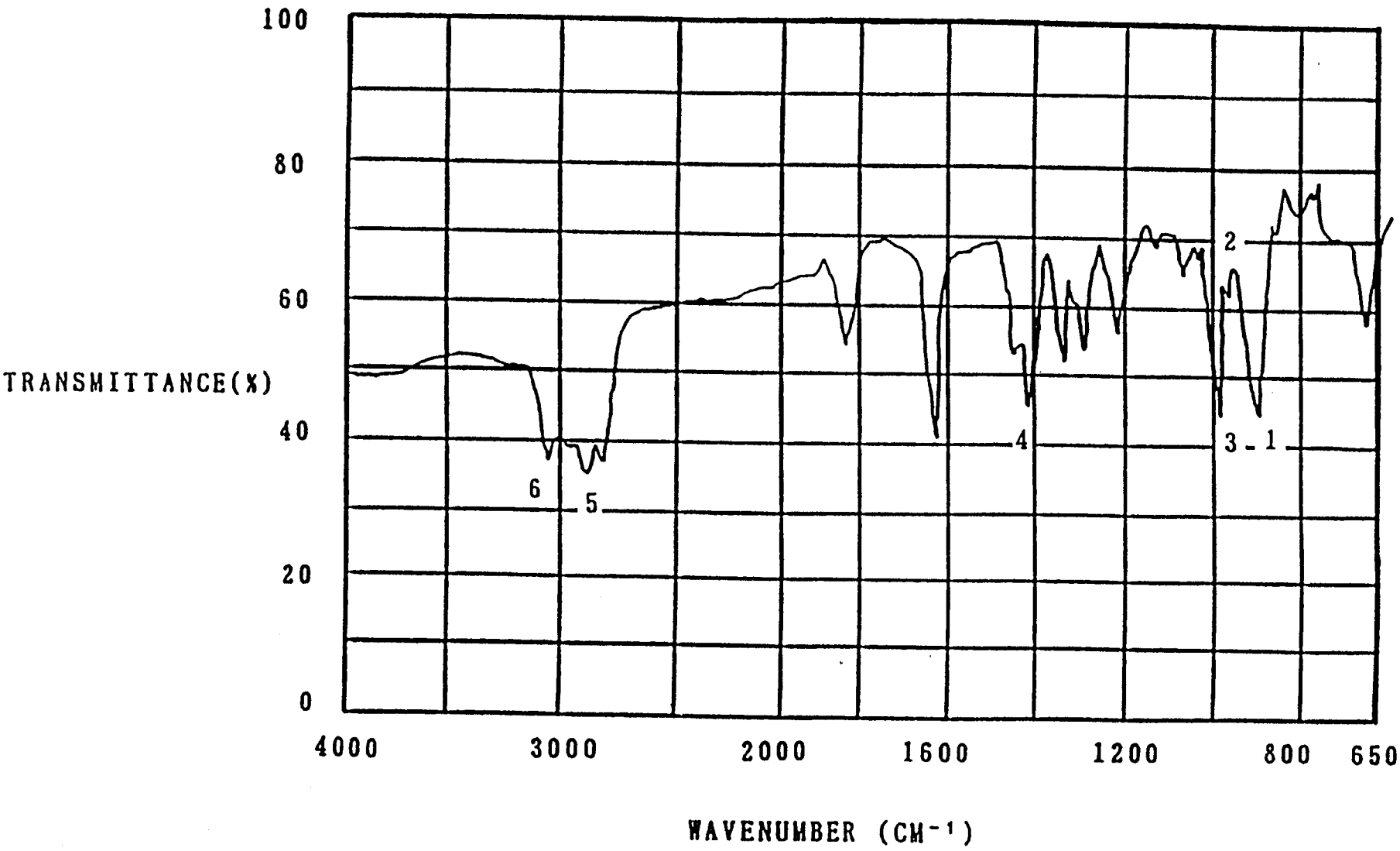
FIG. 2 is a chart of an Infrared absorption spectrum of a film of a syndiotactic poly(1,2-butadiene).

FIG. 2 is a chart of the IR absorption of a film of poly(1,2-butadiene) where the main chain is syndiotactic.

Figure 3:
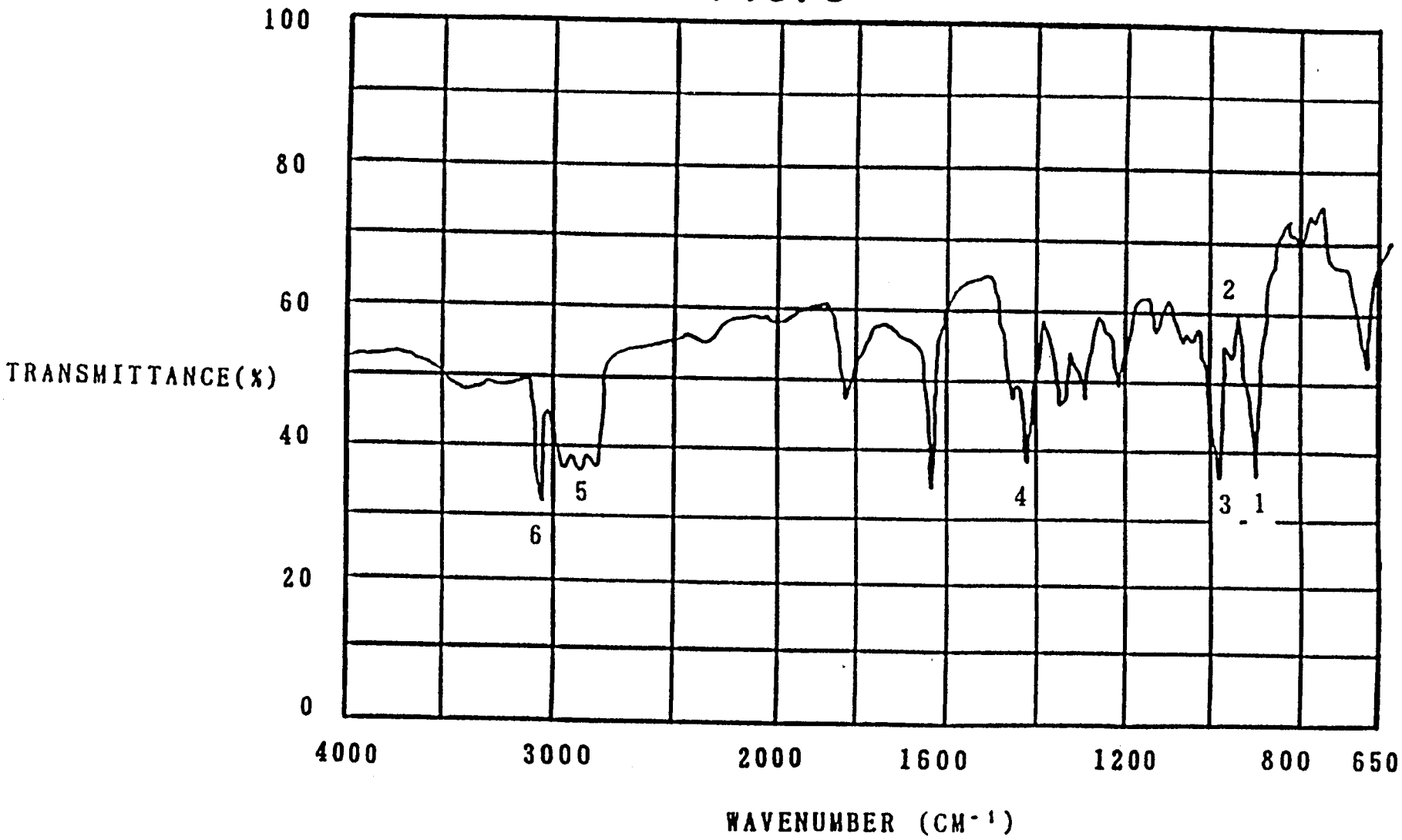
FIG. 3 is a chart of an Infrared absorption spectrum of a film obtained by ultraviolet ray irradiation of the polymer film shown in FIG. 2.

FIG. 3 is a chart of the IR absorption of a film obtained as a result of ultraviolet ray irradiation cross-linking of the polymer film in case of FIG. 2. It will be seen that absorption based on cross-linked groups designated at 6 are increased.

Figure 4:
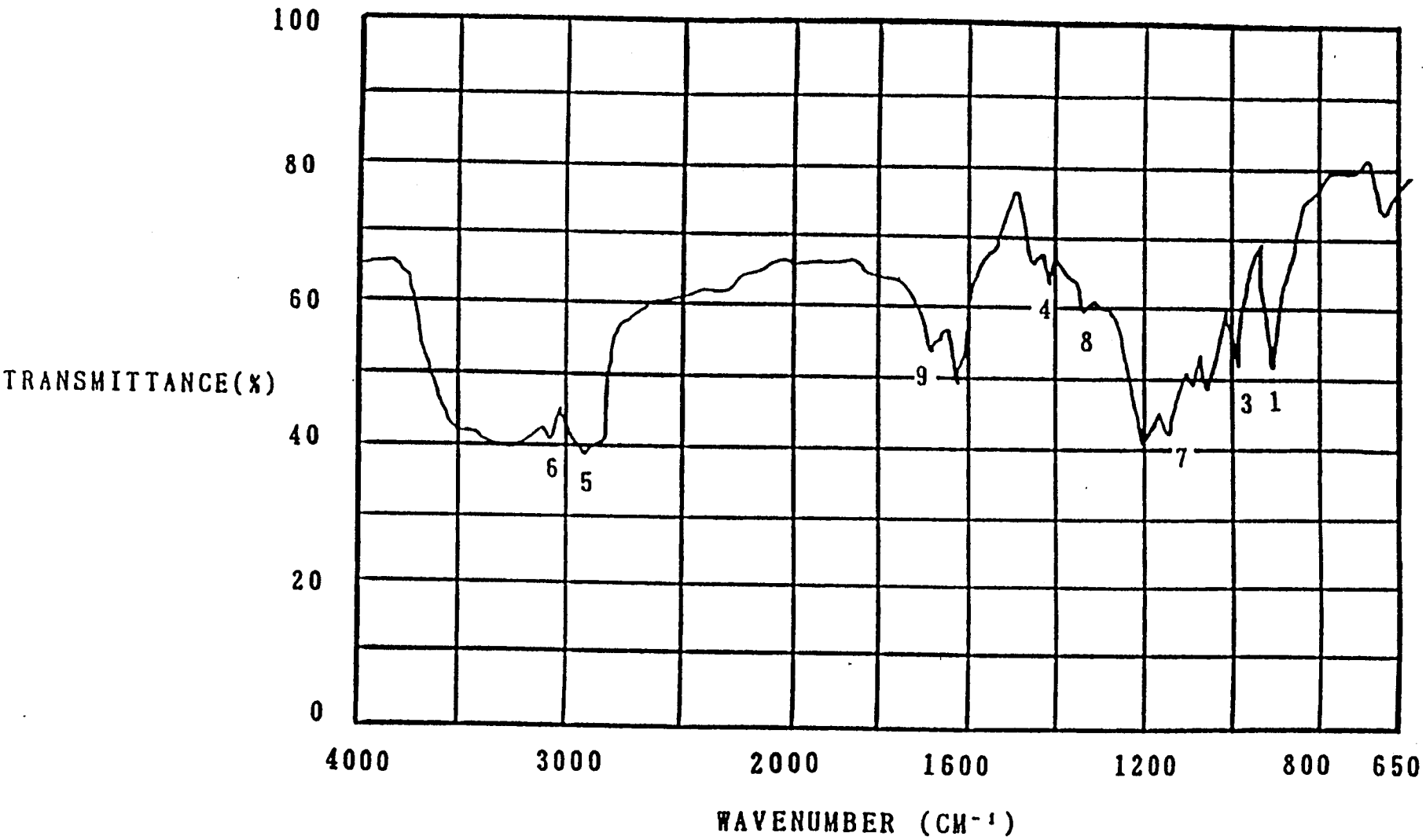
FIG. 4 is a chart of an Infrared absorption spectrum of a film obtained by sulfonation of the polymer film shown in FIG. 2.

FIG. 4 is a chart of the IR absorption of a film as a result of sulfonation of the polymer films shown in FIG. 2. It will be seen that compared to the IR absorption chart of FIG. 2, vinyl groups designated at 1 and 3 are reduced and also that there are absorption based on sulfonic acid groups designated at 7 and 8 and absorption based on carboxyl groups designated at 9.

Figure 5:
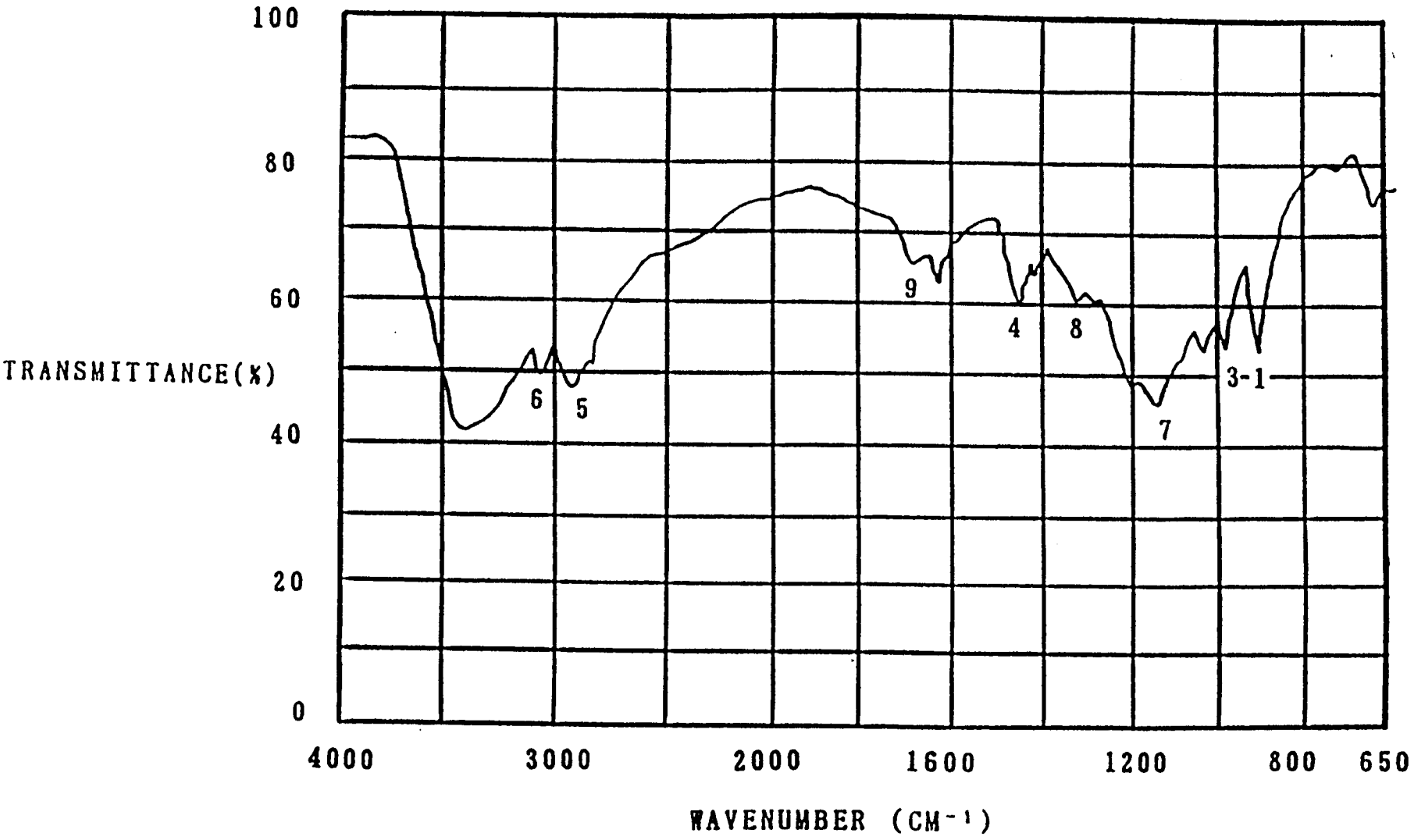
FIG. 5 is a chart of an Infrared absorption spectrum of a film obtained by sulfonation of the polymer film shown in FIG. 3.

FIG. 5 is a chart for the IR absorption of a film as a result of sulfonation of the polymer film as shown in FIG. 3. Compared to the chart of FIG. 3, it will be seen that vinyl groups designated at 1 and 3 are reduced. In addition, it will be seen that there are absorption based on sulfonic acid groups designated at 7 and 8 and absorption of carboxyl groups designated at 9.

As has been shown, it is confirmed that the polymer according to the invention has a main chain having a syndiotactic poly(1,2-butadiene) structure, as shown in FIGS. 4 and 5, and that ion exchange functional groups are introduced into at least part of side chain ethylene groups.

Thus, the fibers according to the examples described above are rich in flexibility and have not so heigh rigidity comparable with those of the conventional ion exchange fibers. Thus, they can be handled in the same way as the usual fibers. Namely, they can be processed into woven and knitted fabrics and non-woven fabrics easily. And also they can be used in combination with other fiber materials or by winding them on cartridge filters. That is, they can be handled in the same way as the usual non-woven fabrics and are thus applicable to various uses.

Moreover, they can be formed directly with usual melt extrusion apparatuses such as melt spinning machines and be formed into non-woven fabrics using usual thermal processors. That is, they permit ready manufacture compared to the conventional ion exchange fibers, and their products can be provided at economical prices.

I claim:

1. A method for manufacturing sheath-core ion exchange fibers comprising the steps of forming sheath-core conjugate fibers by melt spinning syndiotactic poly(1,2-butadiene) having a melting point (Tm °C.) of $75 \leqq Tm < 150$ as a sheath component and a polypropylene polymer or copolymer as a core component, and subsequently carrying out a chemical treatment or physicochemical treatment on said fibers to introduce ion exchange functional groups selected from the group consisting of sulfonic acid groups and sulfonic acid salt groups thereinto.

2. A method of manufacturing sheath-core ion exchange fibers comprising the steps of forming sheath-core conjugate fibers by melt spinning syndiotactic poly(1,2-butadiene) having a melting point (Tm °C.) of $75 \leqq Tm < 150$ as a sheath component and a polypropylene polymer or copolymer as a core component, carrying out a cross-linking treatment on said conjugate fibers with ultraviolet rays or radioactive rays, and subsequently carrying out a chemical treatment or physicochemical treatment on said fibers to introduce ion exchange functional groups selected from the group consisting of sulfonic acid groups and sulfonic acid salt groups thereinto.

* * * * *